United States Patent [19]

Verser

[11] Patent Number: 4,674,290

[45] Date of Patent: Jun. 23, 1987

[54] VENT CONTROL FOR A VESSEL

[75] Inventor: Donald W. Verser, Bartlesville, Okla.

[73] Assignee: Phillips Petroleum Company, Bartlesville, Okla.

[21] Appl. No.: 868,229

[22] Filed: May 28, 1986

[51] Int. Cl.[4] ..... F25J 3/00

[52] U.S. Cl. ..... 62/45; 62/514 R

[58] Field of Search ..... 62/45, 514 R

[56] References Cited

U.S. PATENT DOCUMENTS

| | | | |
|---|---|---|---|
| 3,319,432 | 5/1967 | Nebgen | 62/45 |
| 3,320,756 | 5/1967 | Hashemi | 62/45 |
| 3,383,881 | 5/1968 | Bailey | 62/45 |
| 3,474,633 | 10/1969 | Bailey | 62/45 |
| 3,478,529 | 11/1969 | Boykin | 62/85 |
| 3,809,153 | 5/1974 | Kober | 62/45 |
| 4,358,346 | 11/1982 | Shinskey | 203/1 |

OTHER PUBLICATIONS

"Armstrong Guide to Refrigerated Purging," *Armstrong Bulletin No. 702-C*, published by Armstrong Machine Works of New Braunfels, Texas, pp. 1-15.

Blackburn, G. A. et al., "Effect of Composition on Propane Refrigeration Systems," published by *Gas Processing Association*, pp. 1-3.

*Primary Examiner*—Ronald C. Capossela

*Attorney, Agent, or Firm*—William R. Sharp

[57] ABSTRACT

An apparatus and method for controlling the venting of vapor from a vessel utilizes a differential vapor pressure detection means to measure the difference between vapor pressure in the vessel and the vapor pressure associated with a reference sample which is exposed to the temperature conditions within the vessel. Vapor venting from the vessel is controlled in response to the measured pressure difference. In a preferred embodiment, the invention is applied to a refrigeration system which uses impure refrigerant in its operation and a substantially pure refrigerant for the reference sample, wherein impurities are vented from a refrigerant-containing surge vessel.

17 Claims, 1 Drawing Figure

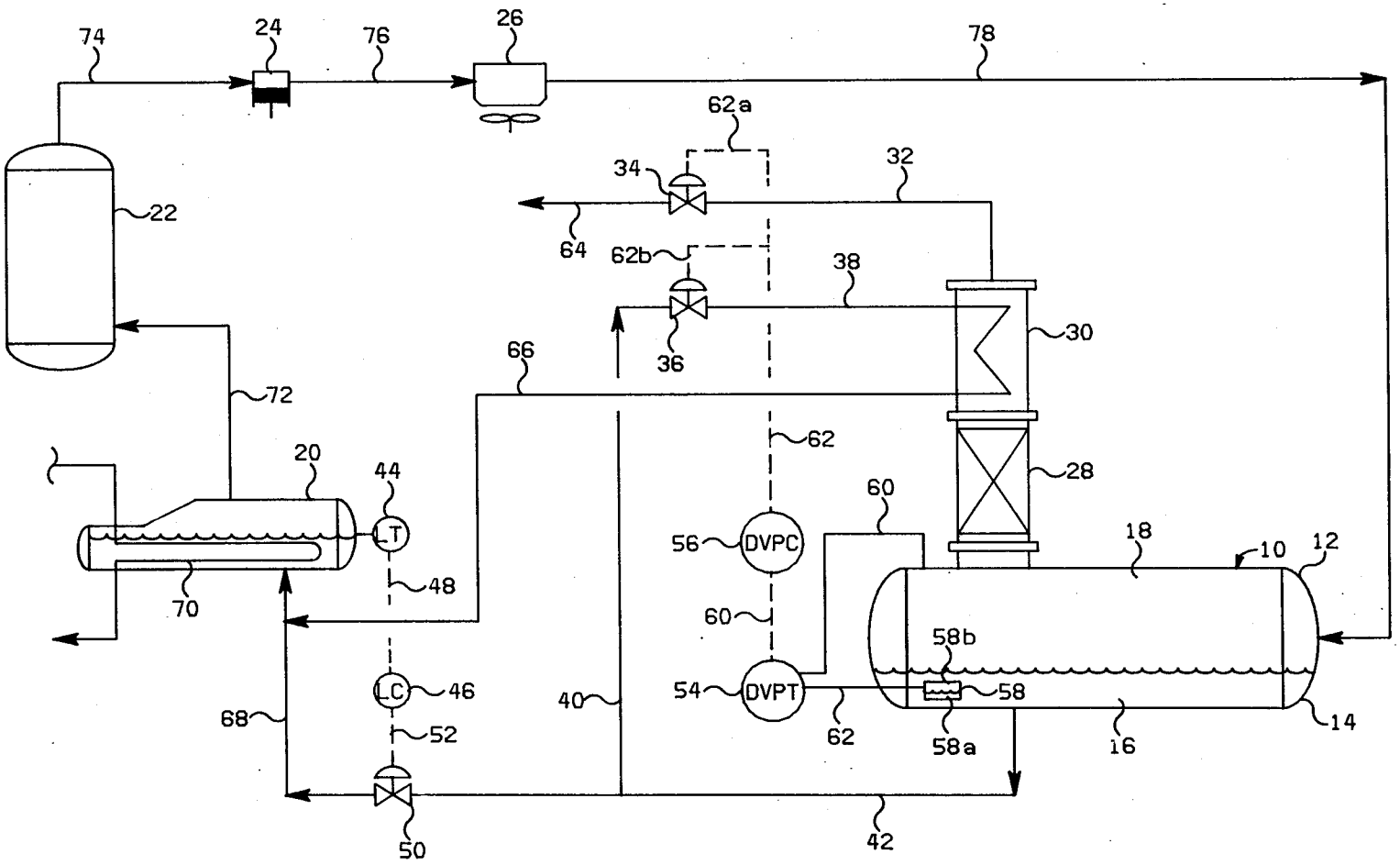
DVPC
DVPT
LT
LC

VENT CONTROL FOR A VESSEL

BACKGROUND OF THE INVENTION

This invention relates to an apparatus and method for controlling the venting of vapor from a vessel.

The invention is particularly applicable to refrigeration systems in which, as will become more apparent below, controlled venting of vapor from a refrigerant-containing vessel is desirable.

Commercial refrigeration systems employed in refineries, for example, typically operate by at least partially vaporizing a liquid refrigerant such as propane to effect cooling, compressing the vaporized refrigerant, and then condensing the compressed refrigerant. In a closed system, the condensed product can then be passed to a vessel, sometimes called a surge vessel, in which the refrigerant exists in both a liquid phase and a vapor phase.

In such refrigeration systems it is usually cheaper and thus desirable to use an impure refrigerant such as commercial grade propane which contains impurities (i.e., ethane). Some problems arise with the use of such impure refrigerants, however. Most importantly, impurities cause an undesirably high vapor pressure against which the compressor must compress, thus leading to a waste of energy in compression. It then becomes necessary to vent vapor from the surge vessel in order to reduce the vapor pressure of the refrigerant.

The oldest and simplest method of venting a surge vessel is manually by an operator who can simply monitor the vessel vapor pressure and open a vent valve when the pressure becomes too high. Such manual venting control is highly inefficient for removing some impurities. Thus, automatic techniques for venting surge vessels were developed. One such technique involves measuring the temperature of the vessel liquid phase, correlating the measured temperature with vapor pressure characteristics of a desired refrigerant composition to be contained in the vessel so as to obtain a desired vapor pressure corresponding to the desired composition, and controlling venting of vapor from the surge vessel in response to the results of the comparison between the actual vessel vapor pressure and the above obtained desired vapor pressure.

Even though prior automatic techniques for the controlled venting of vapor in refrigeration systems accomplish control of vessel vapor pressure to an adequate degree, improvement with respect to accuracy of control, efficiency and complexity of design would be desirable.

SUMMARY OF THE INVENTION

It is therefore an object of the present invention to provide an improved apparatus and method for controlling the venting of vapor from a vessel which provides control which is more efficient, more accurate and simpler than prior control systems.

The above object is realized in a method which comprises: providing in a vessel a liquid phase and a vapor phase (i.e., both phases being an impure refrigerant in a refrigeration system), wherein the vessel has the capability of having vapor vented therefrom; exposing a reference sample (i.e., pure refrigerant), existing in a liquid phase and a vapor phase, to the temperature of one of the phases in the vessel; determining the difference between the pressure of the vapor phase in the vessel and the reference sample vapor phase to yield a differential pressure value; and controlling the venting of vapor from the vessel in response to the differential pressure value.

In another aspect of the invention there is provided an apparatus which comprises: a vessel adapted to contain both a liquid phase and a vapor phase; vent means operable to cause venting of vapor from the vessel; a differential pressure detection means having associated therewith a reference receptacle adapted to contain a reference sample in both a liquid phase and a vapor phase, the reference receptacle being positioned so as to be exposed to temperature conditions within the vessel, wherein the differential pressure detection means is connected to the reference receptacle and the vessel so as to be capable of detecting the difference between vapor pressure in the vessel and vapor pressure in the reference receptacle and generating a differential pressure signal representative of the above vapor pressure difference; and control means for controlling the vent means so as to control the venting of vapor from the vessel in response to the differential pressure signal.

In a preferred embodiment the invention is applied to a refrigeration system using propane refrigerant wherein vapor is vented through a condenser and associated packing which separates most of the propane from the impurities, thereby allowing lighter impurities such as ethane to pass out of the system. The preferred embodiment also utilizes control of a cool side stream of refrigerant through the condenser in response to the above-mentioned differential pressure signal.

Since the invention provides direct sensing of a reference pressure (for the reference sample contained in the reference receptacle) rather than correlating pressure from a measured temperature as in prior techniques, the present invention provides more accurate control of vapor venting to thereby more accurately maintain the desired composition and vapor pressure within the vessel. Consequently, more efficient and reliable long term operation results during which few if any manual adjustments are required to correct for errors in venting control. Further, the present invention requires less instrumentation than prior techniques so as to provide simplicity of design and a minimum of error in control. Finally, the preferred feature whereby a side stream of liquid refrigerant is passed into the condenser (through which vapor is vented) and controlled in response to the measured differential pressure enhances operation efiiciency.

BRIEF DESCRIPTION OF THE DRAWING

The FIGURE is a schematic representation of one embodiment of the invention as applied to a refrigeration system.

DETAILED DESCRIPTION OF THE INVENTION

A preferred embodiment of the invention will now be described with reference to the FIGURE as applied to a refrigeration system, although it should be understood that the invention could be applied to any system in which controlled venting would be desirable.

Various lines illustrated in the FIGURE are designated schematically, where dashed lines represent signal lines and where solid lines represent conduit lines for transmission of fluids therethrough. The signal lines can be pneumatic, electrical or any other means of transmitting information compatible with the transducers (also sometimes called transmitters) and controllers.

Referring to the FIGURE, the illustrated apparatus includes a surge vessel 10, having an upper portion 12 and a lower portion 14, shown as containing a refrigerant existing in a liquid phase 16 and a vapor phase 18; a chiller 20; a suction scrubber 22; a compressor 24; and a condenser 26.

Associated with vessel 10 is some packing 28 which can comprise pall rings or any other suitable means of enhancing liquid-vapor contact with respect to fluids which may flow therethrough. Condenser 30, preferably of the shell and tube type, is positioned between and so as to be in communication with vessel 10 and a conduit line 32 and associated valve 34. Valve 34 has at least two positions, i.e., open and closed, and is operable to cause venting of vapor from vessel 10. Similarly, valve 36 also has at least two positions and is positioned along conduit line 38 which communicates with conduit lines 40 and 42. The combination of conduit lines 38, 40 and 42 form a conduit means extending between condenser 30 and the lower portion 14 of vessel 10. Various other conduit lines will be described in connection with apparatus operation.

The illustrated control instrumentation includes liquid level transducer 44 and level controller 46 associated with chiller 20. Liquid level in chiller 20 is conventionally controlled by means of level transducer 44 generating a liquid level signal representative of the liquid level which is transmitted via signal line 48 to level controller 46. Level controller 46 generates in response thereto a level control signal which is transmitted to valve 50 via signal line 52. Valve 50 is appropriately responsive to the level control signal.

The control instrumentation further includes a differential vapor pressure transducer (DVPT) 54 and a differential vapor pressure controller (DVPC) 56. As shown, DVPT 54 is connected to the upper portion 12 of vessel 10 and to a reference receptacle (sometimes referred to as a bulb) 58 via respective conduit lines 60 and 62. Reference receptacle 58 is adapted to contain a reference sample, in the illustrated embodiment a substantially pure refrigerant, in both a liquid phase 58*a* and a vapor phase 58*b*. DVPT 54 can be any type of transducer or combination of transducers capable of detecting the difference between vapor pressure in the vessel and vapor pressure in the reference receptacle 58, and generating a differential pressure signal representative of the vapor pressure difference. DVPC 56 can be any type of conventional controller, such as a local type controller, capable of generating an appropriate control signal in response to the differential pressure signal and a set point signal (not represented in the FIGURE). Particularly preferred differential vapor pressure transducing and control instruments are Model Nos. 13VA and 43AP, respectively, manufactured by the Foxboro Company of Foxboro, Mass.

Reference receptacle 58 is preferably positioned within vessel 10 so as to be in contact with liquid phase 16. Such positioning of the reference receptacle is preferred because this provides rapid and accurate response of vapor within the receptacle to temperature changes. Although positioning of reference receptacle 58 as illustrated is preferred, the receptacle can be positioned at any location within vessel 10 such as for example to contact vapor phase 18, or can be positioned anywhere in the system which allows exposure of the reference sample in the receptacle to the temperature of one of phases 16 or 18. The temperatures of phases 16 and 18 are typically about the same since the two phases are approximately in equilibrium. Reference receptacle 58 could be positioned within a section of conduit line 42 closely adjacent to vessel 10 where temperature conditions are substantially equivalent to those within the vessel itself. Such positioning of the receptacle may in some systems be simpler to implement than positioning the receptacle as illustrated.

With respect to operation of the illustrated refrigeration system, the invention is applicable to any refrigerant containing lighter impurity components which are desired to be vented from the system. The term "lighter impurity" refers to any impurity component in the refrigerant which is of a lower boiling point than the primary component. Suitable refrigerants include those having as their primary component, for example, any of the lower alkanes of which propane is most typical in commercial refrigeration systems. Such propane refrigerants include "refrigerant grade" propane containing up to about 2% ethane, and also "commercial grade" propane containing about 2% to about 9% ethane and also in some cases appreciable amounts of other impurities such as methane. The present invention is especially useful with commercial grade propane in view of its excellent capability to consistently and accurately vent vaporous impurities from vessel 10 to thereby maintain within the vessel a desirably and substantially pure refrigerant.

In the following description of system operation, some operating conditions such as pressures, etc. will be given. It should be understood that these conditions are typical of a commercial refrigeration system using commercial grade propane and are given for the sake of illustration only.

As noted previously, the refrigerant exists in both a liquid phase 16 and a vapor phase 18, the pressure of vapor phase 18 typically being about 200 psig and the temperature of each phase about 100° F. The lighter, more volatile impurity components (i.e., including ethane) will tend to concentrate within vapor phase 18, along with some primary component (i.e., propane). Liquid phase 16 comprises primarily propane.

DVPT 54 detects the difference between the pressure of vapor phase 18 and the pressure of vapor phase 58*b* and generates a differential pressure signal representative of the pressure difference. DVPC 56 receives the differential pressure signal via signal line 60 and generates in response to the difference between the differential pressure signal and a predetermined set point a control signal which is transmitted to valves 34 and 36 via signal line 62 and signal lines 62*a* and 62*b* which branch from line 62.

According to the simplest and most preferred mode of valve control, DVPC 56 generates only two different control signals in which case one control signal causes valves 34 and 36 to open and the other control signal causes valves 34 and 36 to close. The preselected set point for DVPC 56 corresponds to a certain vapor pressure difference ($\Delta P$) and is typically the upper limit desired for $\Delta P$. Thus, when the actual, measured $\Delta P$ reaches the set point, DVPC 56 generates a control signal causing valves 34 and 36 to open so as to allow venting of vapor from vessel 10 and flow of refrigerant through condenser 30. Assuming for the sake of illustration that the set point corresponds to a $\Delta P$ of 5 psi and that DVPC 56 has a dead band of 2 psi, receipt by DVPC 56 of a differential pressure signal corresponding to a pressure difference of 5 psi will cause DVPC 56 to generate a control signal for opening valves 34 and 36. Valves 34 and 36 would then remain open until the pressure difference dropped to 3 psi (2 psi below set point of 5 psi), whereupon DVPC 56 generates a control signal causing valves 34 and 36 to close.

Of course, the above described mode of control is only one example compatible with the present invention. Other modes of control are within the scope of the present invention, such as a mode wherein valves 34 and 36 could be variably opened in response to a varying control signal.

Opening of valve 34 allows venting of vapor from vessel 10. During such venting, vapor from vessel 10 flows through packing 28 and then through condenser 30. Most of the refrigerant primary component, such as propane, in the vapor is condensed by condenser 30. The condensed vapor then returns by gravity to vessel 10. The uncondensed vapor consists primarily of impurities such as ethane which pass from condenser 30 through conduit line 32 and through valve 34. The vented impurities can be passed via line 64 to some other process in a commercial plant for example, or the vented impurities can simply be passed via line 64 to the atmosphere.

Opening of valve 36 permits a flow of liquid refrigerant through conduit line 40 via line 42. Liquid refrigerant flows into line 42 after having been withdrawn from vessel 10. The refrigerant flows from line 40 into and through valve 36 to effect a pressure drop and cooling of the refrigerant. Flow of the cool refrigerant through condenser 30 cools vapor passing therethrough to condense a portion of the vapor, as previously discussed. Refrigerant is discharged from condenser 30 and passed to chiller 20 via line 66.

It should be noted that control of valve 36 in response to the same control signal which controls valve 34 synchronizes venting and flow of refrigerant through condenser 30. This is advantageous over continuous refrigerant flow through condenser 30 insofar as intermittent and synchronized flow in accordance with this aspect of the invention minimizes vaporization of refrigerant in its flow across valve 36. Minimizing such vaporization is desirable to maximize liquid refrigerant available for vaporization and cooling in conjunction with chiller 20 and valve 50. Of course, in the preferred embodiment, venting of vessel 10 and refrigerant flow through condenser 30 occur simultaneously.

Most of the liquid refrigerant withdrawn from vessel 10 flows through conduit line 42 to valve 50, across which liquid refrigerant is "flashed". In other words, the refrigerant drops in pressure, typically from about 200 psig to about 3 psig, in its flow through valve 50. Vaporization of some of the refrigerant results and cooling of the refrigerant is effected. Chiller 20 receives refrigerant via conduit line 68. Temperatures in chiller 20 will typically be as low as −40° F. A process fluid can be cooled by passing it through coils 70 so as to be in heat exchange relationship with the cold refrigerant in chiller 20.

A stream of vapor is passed from chiller 20 into suction scrubber 22 by means of conduit line 72. Suction scrubber 22 functions to remove any entrained liquids to ensure such liquids do not enter compressor 24.

A vapor stream passes from suction scrubber 22 to compressor 24 via conduit line 74. Compressor 24 compresses the vapor and discharges a stream through conduit line 76 to condenser 26. A substantial portion of the vapor is condensed by condenser 26 to yield another stream which flows through conduit line 78 to vessel 10.

Thus, there is provided by the present invention an apparatus and method for controlling the venting of vapor from a vessel which accomplishes accurate, reliable and simple control, as discussed previously. By applying the invention to a refrigeration system using commercial grade propane with about 6% ethane by weight, a decrease of ethane content to about 1% can be expected in the vapor phase contained in a surge vessel. Such purification of the refrigerant vapor in a surge vessel by means of venting impurities therefrom lowers the vapor pressure and thus reduces the required compression horsepower.

Obviously many modifications and variations of the present invention are possible in light of the above teachings. It is therefore to be understood that within the scope of the appended claims the invention many be practiced otherwise than as specifically described.

That which is claimed is:

1. A method comprising:

providing in a vessel a first liquid phase and a first vapor phase, wherein said vessel has the capability of having vapor vented therefrom;

exposing a reference sample, existing in a second liquid phase and a second vapor phase, to the temperature of one of said first phases;

determining the difference between the pressure of said first vapor phase and the pressure of said second vapor phase to yield a differential pressure value; and controlling the venting of vapor from said vessel in response to said differential pressure value.

2. A method as recited in claim 1, wherein there is provided a first condenser, in communication with said vent means and said vessel, through which vented vapor can flow, said method further comprising:

withdrawing at least a portion of said first liquid phase from said vessel;

providing a means enabling flow of at least some of said withdrawn liquid through said first condenser so as to be in heat exchange relationship with vented vapor;

controlling flow of liquid through said first condenser in response to said differential pressure value.

3. A method as recited in claim 2, wherein each of said controlling steps is performed so that any venting of vapor from said vessel and flow of liquid through said first condenser occur simultaneously.

4. A method as recited in claim 3, wherein said first vapor phase comprises at least first and second components and wherein said first component is condensed upon venting of vapor through said first condenser and flow of liquid through said first condenser.

5. A method as recited in claim 1, wherein said first vapor phase and said first liquid phase comprise a refrigerant.

6. A method as recited in claim 5, further comprising:

vaporizing at least some of said withdrawn liquid to yield a first stream;

passing said first stream to a compressor to yield a second stream;

passing said second stream to a second condenser to yield a third stream;

passing said third stream to said vessel.

7. A method as recited in claim 6, wherein said first component comprises propane and said second component comprises ethane.

8. A method as recited in claim 2, wherein each of said controlling steps is automatically implemented.

9. A method as recited in claim 1, wherein said reference sample is contained in a reference receptacle and wherein said exposing step comprises positioning said reference receptacle in said vessel so as to be in contact with said first liquid phase.

10. An apparatus comprising:

a vessel adapted to contain both a liquid phase and a vapor phase;

vent means operable to cause venting of vapor from said vessel;

a differential pressure detection means having associated therewith a reference receptacle adapted to contain a reference sample in both a liquid phase and a vapor phase, said reference receptacle being positioned so as to be exposed to temperature conditions within said vessel, wherein said differential pressure detection means is connected to said reference receptacle and said vessel so as to be capable of detecting the difference between vapor pressure in said vessel and vapor pressure in said reference receptacle and generating a differential pressure signal representative of said vapor pressure difference; and control means for controlling said vent means so as to control the venting of vapor from said vessel in response to said differential pressure signal.

11. An apparatus as recited in claim 10, wherein said vessel has an upper portion and a lower portion, said apparatus further comprising:

a condenser positioned between and so as to be in communication with said vent means and said vessel;

conduit means extending between the lower portion of said vessel and said condenser;

valve means associated with said conduit means and having at least two positions;

wherein said control means controls the position of said valve means in response to said differential pressure signal.

12. An apparatus as recited in claim 11, wherein said vent means includes a valve.

13. An apparatus as recited in claim 10, wherein said reference receptacle is positioned within said vessel.

14. A refrigeration apparatus of the type wherein a liquid phase of a refrigerant is vaporized, compressed and condensed, said refrigerant being supplied from a vessel adapted to contain a refrigerant in both a vapor phase and a liquid phase, the improvement comprising:

vent means operable to cause venting of vapor from said vessel;

a differential pressure detection means having associated therewith a reference receptacle adapted to contain a reference sample in both a liquid phase and a vapor phase, said reference receptacle being positioned so as to be exposed to temperature conditions within said vessel, wherein said differential pressure detection means is connected to said reference receptacle and said vessel so as to be capable of detecting the difference between vapor pressure in said vessel and vapor pressure in said reference receptacle and generating a differential pressure signal representative of said vapor pressure difference; and control means for controlling said vent means so as to control the venting of vapor from said vessel in response to said differential pressure signal.

15. An apparatus as recited in claim 14, wherein said vessel has an upper portion and a lower portion, said apparatus further comprising:

a condenser positioned between and so as to be in communication with said vent means and said vessel;

conduit means extending between the lower portion of said vessel and said condenser;

valve means associated with said conduit means and having at least two positions, wherein said control means controls the position of said valve means in response to said differential pressure signal.

16. An apparatus as recited in claim 15, wherein said vent means includes a valve.

17. An apparatus as recited in claim 16, wherein said reference receptacle is positioned within said vessel.

* * * * *